US009016474B2

(12) United States Patent
Ritzberger et al.

(10) Patent No.: US 9,016,474 B2
(45) Date of Patent: Apr. 28, 2015

(54) TRANSPORT CONTAINER

(71) Applicant: Georg Utz Holding AG, Bremgarten (CH)

(72) Inventors: Axel Ritzberger, Altendorf (CH); Wolfgang Faust, Schuttorf (DE); Gerhard Eckbrett-Welz, Suddendorf (DE)

(73) Assignee: Georg Utz Holding AG, Bremgarten (CH)

( * ) Notice: Subject to any disclaimer, the term of this patent is extended or adjusted under 35 U.S.C. 154(b) by 0 days.

(21) Appl. No.: 13/683,930

(22) Filed: Nov. 21, 2012

(65) Prior Publication Data

US 2013/0081971 A1 Apr. 4, 2013

(51) Int. Cl.

| | |
|---|---|
| ***B65D 21/00*** | (2006.01) |
| ***B65D 19/02*** | (2006.01) |
| ***B65D 6/16*** | (2006.01) |
| ***B65D 25/08*** | (2006.01) |
| ***B65D 21/02*** | (2006.01) |

(52) U.S. Cl.

CPC *B65D 7/24* (2013.01); *B65D 19/02* (2013.01); *B65D 2519/00646* (2013.01); *B65D 2519/00338* (2013.01); *B65D 25/08* (2013.01); *B65D 2519/00582* (2013.01); *B65D 21/0215* (2013.01); *B65D 2519/0096* (2013.01); *B65D 2519/009* (2013.01)

(58) Field of Classification Search

USPC ..... 206/511, 509, 517, 747, 745; 220/666, 220/4.32, 4.28, 6

See application file for complete search history.

(56) References Cited

U.S. PATENT DOCUMENTS

| | | | | |
|---|---|---|---|---|
| 2,793,780 | A * | 5/1957 | Walklet et al. | 220/6 |
| 4,186,841 | A * | 2/1980 | Buckley et al. | 220/6 |
| 4,591,065 | A * | 5/1986 | Foy | 220/7 |
| 4,673,087 | A * | 6/1987 | Webb | 206/600 |
| 5,797,508 | A * | 8/1998 | Loftus et al. | 220/6 |
| 7,484,634 | B2 * | 2/2009 | Apps | 220/7 |
| 2008/0169285 | A1 * | 7/2008 | Marazita et al. | 220/7 |
| 2008/0296308 | A1 * | 12/2008 | Barbalho et al. | 220/666 |
| 2009/0272739 | A1 * | 11/2009 | Fredrickson | 220/4.32 |
| 2011/0139775 | A1 * | 6/2011 | Nolan | 220/6 |
| 2011/0168599 | A1 * | 7/2011 | Koenig et al. | 206/509 |

FOREIGN PATENT DOCUMENTS

| | | | |
|---|---|---|---|
| DE | 102005031526 | A1 | 4/2007 |
| GB | 2257422 | A | 1/1993 |

* cited by examiner

*Primary Examiner* — Anthony Stashick
*Assistant Examiner* — James Way
(74) *Attorney, Agent, or Firm* — Roberts IP Law; John Roberts

(57) ABSTRACT

The invention relates to a transport container comprising a rectangular base, with feet located at the underside thereof, with side walls that can pivot about hinges and that rise from said base, wherein the side walls, which lie on top in the folded-together state, and the bordering base edge comprising the hinges form support surfaces for the feet of an identical second container, the feet thereof being located below the base, characterized in that recesses are provided in the left and the right side area of the side walls, which lie on top in the folded-together state, the recesses being separated from one another by ribs and being used to receive protrusions formed on the bottom side of the feet, the height of the protrusions being less than the depth of the recesses.

11 Claims, 2 Drawing Sheets

TRANSPORT CONTAINER

Figure 1:
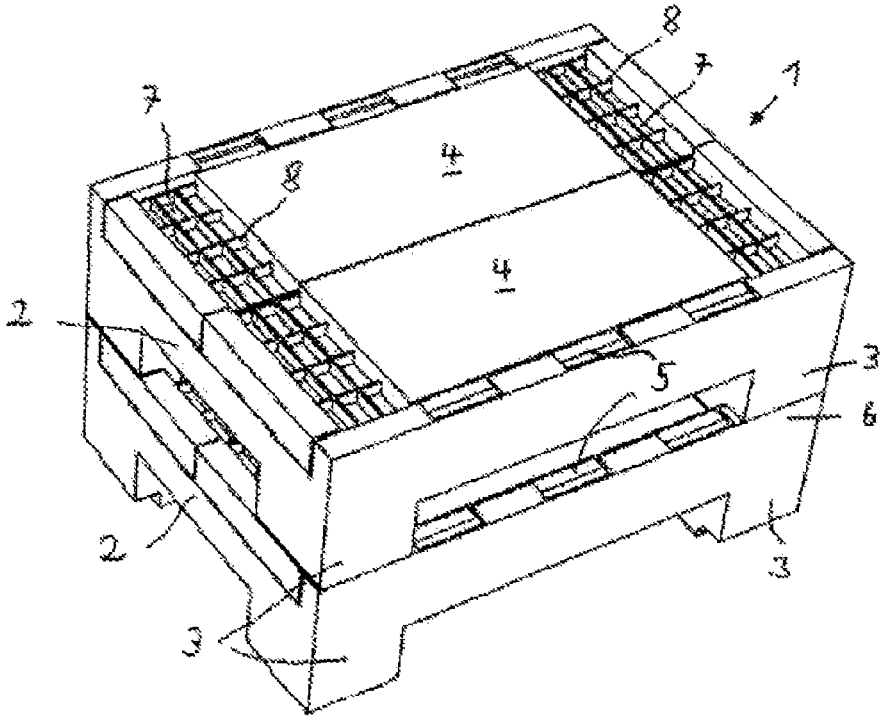

The invention relates to a transport container comprising a rectangular base, with feet located at the underside thereof, with side walls that can pivot about hinges and that rise from the base, wherein the side walls, which lie on top in the folded-together state, and the bordering base edge comprising the hinges form support surfaces for the feet of an identical second container, the feet thereof being located below the base.

Such transport containers are designed to be foldable so that when the empty transport containers are returned, space can be saved.

In transport on trucks or by ship, the stacked, folded-together containers are secured against slipping by wrapping belts around them. Another method is to design complementary shapes into each container so that when stacked one on top of the other, the containers mutually hold together.

However, these mutually complementary fixing devices have the disadvantage that they increase the design height of the folded-together transport containers so that an insufficient number of containers can be stacked on top of one another.

The object of the invention is, therefore, to design a transport container of the type mentioned above such that the fixing elements in the respective transport container minimize the design height of the folded-together container.

The invention accomplishes this object by providing recesses in the left and the right side area of the side walls, which lie on top in the folded-together state, the recesses being separated from one another by ribs and being used to receive protrusions formed on the bottom side of the feet, the height of the protrusions being less than the depth of the recesses.

In this way, recesses are formed in the outside of the side walls, which lie on top in the folded-together state, in the form of a matrix, the recesses being separated from one another by a rib structure as is generally common in such containers.

The recesses receive the protrusions formed on the feet. Because the height of the protrusions is less than the depth of the recesses, the area of the foot surrounding the protrusions sits fully on the bordering edge in which the hinges for the side wall are provided, whereupon the load of the transport containers stacked on top of one another is absorbed by the feet and the bordering edge.

According to claim 2, the protrusions are designed as truncated pyramids and the recesses have a complementary shape.

This has the advantage that, when stacking, the protrusions find their way into the recesses in a simple manner.

According to claim 3, the shorter side walls are located beneath the longitudinal walls in the folded together state. Thus, in this exemplary embodiment, the recesses are provided in the longitudinal sides.

By having the upper edges of the longitudinal side walls sit against one another in the folded together state as according to claim 4, a flat support surface is ensured.

In another exemplary embodiment according to claim 5, using a welded-on reinforcement strip, the recess area is divided into two areas to the left and right next to the strip, and a channel is formed in the protrusion area of the feet as a complement thereto.

Thus, it is provided, for example, that the recesses are formed in three rows on each side of the longitudinal side, wherein the middle row is covered by the welded strip. As a complement thereto, the space between the two protrusion rows that fit into the recesses is left open so that the reinforcement strip can be received there.

The invention is illustrated and described in detail below with the aid of drawings.

Shown are:

FIG. 1: two transport containers stacked one on top of the other in a first embodiment FIG. 2: the two transport containers as seen from the bottom side FIG. 3: two transport containers stacked one on top of the other in an alternative embodiment FIG. 4: the two transport containers according to FIG. 3 as seen from below FIG. 5: the two transport containers according to FIG. 1 stacked one on top of the other in a side view In each of the figures, there are two identical transport containers shown in perspective view and labeled with the reference number 1. Each comprises a base 2 with feet 3 located on the bottom side thereof in the corner areas. Side walls 4 extend upward from the base 2, but only the longitudinal side walls can be seen in FIGS. 1 to 4. The shorter side walls are folded down onto the base beneath the longitudinal side walls 4, whereas the longitudinal side walls 4 are folded down toward one another onto the shorter side walls, the upper edges of said longitudinal side walls meeting.

The folding process is made possible by way of hinges 5 which are located in bordering edges 6 that are elevated from the base 2.

In this example, recesses 7 are formed in the side areas of the outside of the longitudinal side walls 4 in three rows, the recesses being separated from one another by a rib structure 8.

Figure 2:
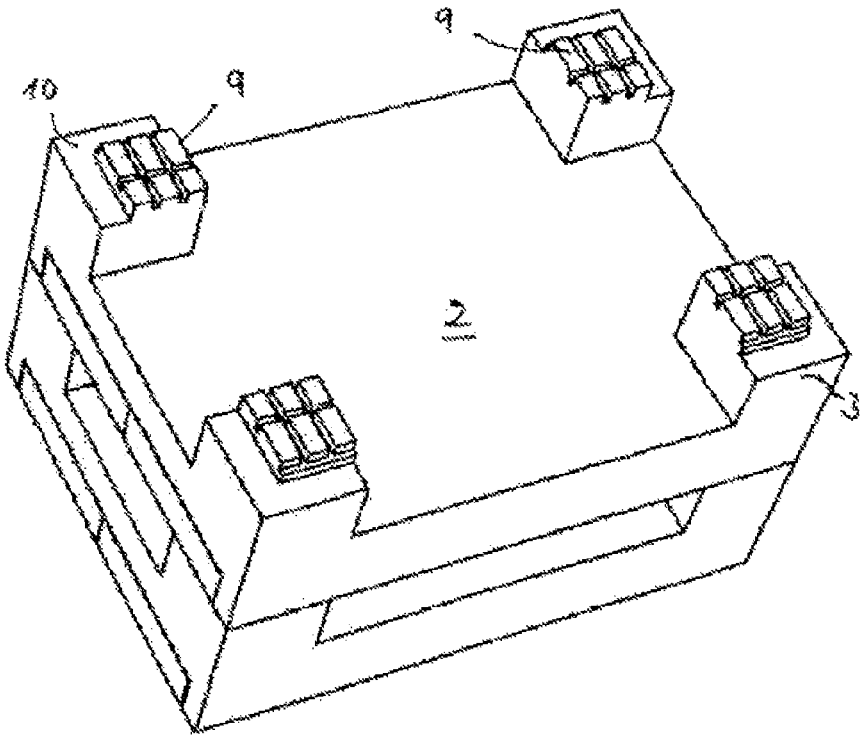

As can be seen in FIG. 2, protrusions 9 are formed in three rows at the bottom sides of the feet 3 in this example as well, the protrusions being surrounded by the angular support surface 10 of the foot 3.

When the transport containers 1 are stacked on top of one another, the protrusions 9 fit into the recesses 7, and in the present exemplary embodiment this process is facilitated by the protrusions having tapered side walls that are complementary to the side walls of the recesses 7.

Figure 3:
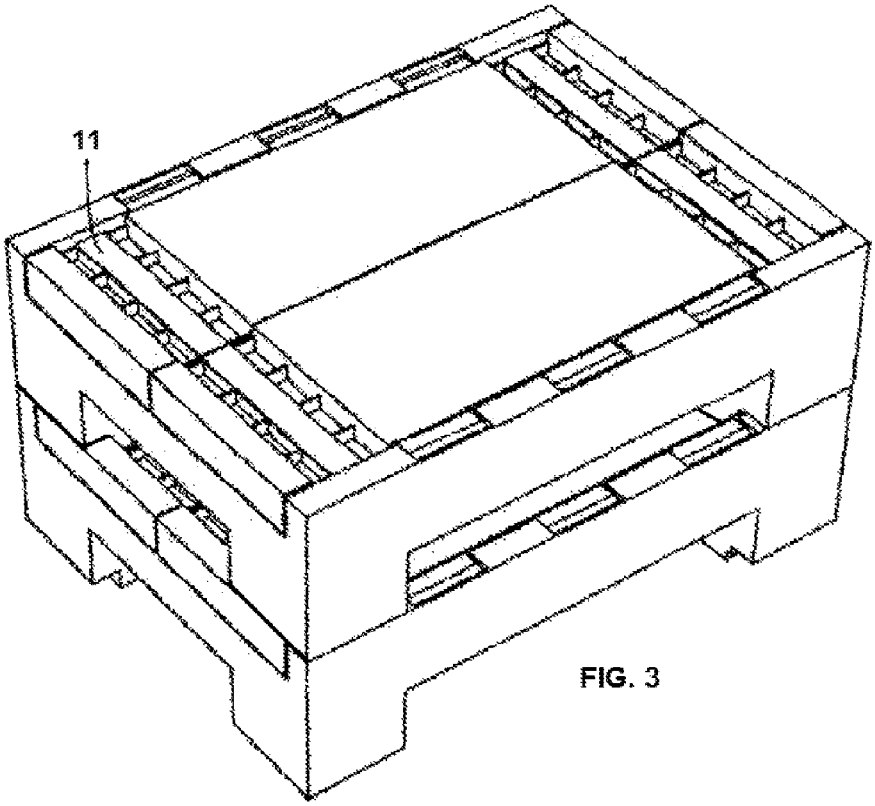
Figure 4:
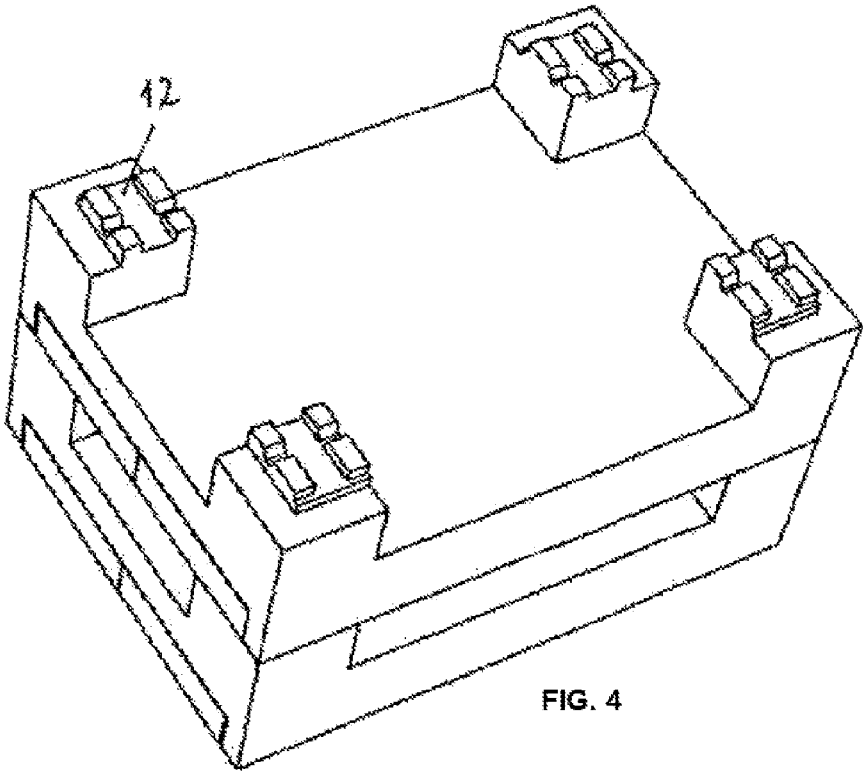

Shown in FIG. 3 is an alternative embodiment of the transport container 1. In this example, a reinforcement strip 11 is welded on the middle recess row, the strip corresponding to the protrusion structure of the feet 3 as shown in FIG. 4. A channel-like open space 12 is left open between the two outer protrusion rows.

The height of the protrusions 9 is selected to be less than the depth of the recesses 7 so as to ensure that the angular support surface 10 of the feet 3 sits on the top side of the bordering edge 6 and/or on the side edges of the longitudinal side walls 4.

The manner in which the transport container 1 is folded together is shown schematically in FIG. 5. The shorter side walls are folded onto the base 2 about hinges 13. Then, the longitudinal side walls 4 are folded down onto the shorter side walls about hinges 5.

The protrusions 9 correspond to the structure of the complementary recesses 7.

The invention claimed is:

1. A transport container comprising:

a rectangular base comprising four corners, with feet extending downward from the underside thereof at each of the four corners, and on each of the feet, a plurality of adjacent protrusions extending downward from a bottom surface thereof;

side walls adapted to pivot about hinges and that rise up from the base, wherein the side walls, which lie on top in the folded-together state, and a bordering base edge comprising the hinges form first support surfaces for the feet of an identical second container;

recesses in the side walls that lie on top in the folded-together state, the recesses separated from one another by ribs and adapted to receive the protrusions formed on the bottoms of the feet of an identical second container when an identical second container is stacked on the transport container, the height of the protrusions being less than the depth of the recesses;

the feet comprising second support surfaces at least partially surrounding the protrusions and adapted to sit on the first support surfaces of an identical second container when the transport container is stacked on an identical second container;

wherein the bordering base edge is adapted to absorb the entire load of an identical second container stacked on the transport container.

2. A transport container according to claim 1, wherein one or more of the protrusions form truncated pyramids and the corresponding recesses have a complementary shape thereto.

3. A transport container according to claim 1, wherein the side walls comprise a shorter side wall and a longer side wall, the shorter side wall located beneath the longer side wall in the folded together state.

4. A transport container according to claim 1, wherein the upper edges of the side walls sit against one another in the folded-together state.

5. A transport container according to claim 1, wherein at least one of the recess areas is divided into two areas to the left and right of a reinforcement strip and a channel is formed complementary thereto in the protrusion area of the corresponding feet.

6. A transport container according to claim 2, wherein the side walls comprise a shorter side wall and a longer side wall, the shorter side wall located beneath the longer side wall in the folded together state.

7. A transport container according to claim 2, wherein the upper edges of the side walls sit against one another in the folded-together state.

8. A transport container according to claim 3, wherein the upper edges of the side walls sit against one another in the folded-together state.

9. A transport container according to claim 2, wherein at least one of the recess areas is divided into two areas to the left and right of a reinforcement strip and a channel is formed complementary thereto in the protrusion area of the corresponding feet.

10. A transport container according to claim 3, wherein at least one of the recess areas is divided into two areas to the left and right of a reinforcement strip and a channel is formed complementary thereto in the protrusion area of the corresponding feet.

11. A transport container according to claim 4, wherein at least one of the recess areas is divided into two areas to the left and right of a reinforcement strip and a channel is formed complementary thereto in the protrusion area of the corresponding feet.

* * * * *